US011396178B2

(12) United States Patent
Yamagata

(10) Patent No.: US 11,396,178 B2
(45) Date of Patent: Jul. 26, 2022

(54) LIQUID DISCHARGE APPARATUS

(71) Applicant: SEIKO EPSON CORPORATION, Tokyo (JP)

(72) Inventor: Toshiyuki Yamagata, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/083,844

(22) Filed: Oct. 29, 2020

(65) Prior Publication Data

US 2021/0129529 A1 May 6, 2021

(30) Foreign Application Priority Data

Oct. 31, 2019 (JP) ..... JP2019-198148

(51) Int. Cl.
*B41J 2/045* (2006.01)
*B41J 2/14* (2006.01)

(52) U.S. Cl.
CPC ..... *B41J 2/04581* (2013.01); *B41J 2/04588* (2013.01); *B41J 2/14201* (2013.01)

(58) Field of Classification Search
CPC . B41J 2/04596; B41J 2/04541; B41J 2/04588
See application file for complete search history.

(56) References Cited

U.S. PATENT DOCUMENTS

| | | | |
|---|---|---|---|
| 6,168,261 | B1 | 1/2001 | Miyake et al. |
| 10,603,908 | B2 * | 3/2020 | Suzuki ..... B41J 2/04596 |
| 2003/0085962 | A1 | 5/2003 | Junhua |
| 2017/0057218 | A1 | 3/2017 | Zhang |

FOREIGN PATENT DOCUMENTS

| | | |
|---|---|---|
| JP | H06-079956 | 3/1994 |
| JP | 2003-118113 | 4/2003 |
| JP | 2015-112828 | 6/2015 |
| JP | 2017-043024 | 3/2017 |

* cited by examiner

*Primary Examiner* — Lam S Nguyen
(74) *Attorney, Agent, or Firm* — Workman Nydegger

(57) ABSTRACT

A liquid discharge apparatus includes a drive waveform generator configured to generate a common drive waveform including, in one cycle, a first period having a discharge waveform including a first element for changing a potential from a first potential to a second potential and a second element for changing a potential from the second potential to a third potential, and a second period having a first potential change waveform for decreasing deformation of the piezoelectric device as compared to deformation of the piezoelectric device when the first potential is supplied, and a waveform selector configured to supply the discharge waveform to the piezoelectric device in the first discharge section that discharges the liquid, and supply the first potential change waveform to the piezoelectric device in the second discharge section that does not discharge the liquid.

6 Claims, 7 Drawing Sheets

LIQUID DISCHARGE APPARATUS

The present application is based on, and claims priority from JP Application Serial Number 2019-198148, filed Oct. 31, 2019, the disclosure of which is hereby incorporated by reference herein in its entirety.

BACKGROUND

1. Technical Field

The present disclosure relates to a liquid discharge apparatus.

2. Related Art

A technique relating to a liquid discharge apparatus is disclosed in JP-A-2017-43024. In the technique, when a nozzle discharge failure is detected, the print mode is switched from a normal mode to a discharge disabling mode. In the discharge disabling mode, driving of all piezoelectric devices for discharging ink from nozzles is disabled, and any ink micro-vibration operation is disabled to prevent thickened ink that is produced around the nozzles from entering pressure chambers.

The technique in JP-A-2017-43024 also describes that when the supply of a drive signal to the piezoelectric devices is interrupted, the piezoelectric devices hold the potentials at the time and maintain their deformed state. Accordingly, in the technique discussed in JP-A-2017-43024, when the print mode is switched from the normal mode to the discharge disabling mode, depending on the potential that is applied in the normal mode, the piezoelectric devices may be held in the deformed state. The piezoelectric devices maintained in the deformed state are subject to stress, and may result in deterioration.

SUMMARY

According to an aspect of the present disclosure, a liquid discharge apparatus is provided. The liquid discharge apparatus includes a first discharge section including a nozzle configured to discharge a liquid, a pressure chamber in communication with the nozzle, and a piezoelectric device configured to change a liquid pressure in the pressure chamber, a second discharge section including a nozzle configured to discharge the liquid, a pressure chamber in communication with the nozzle, and a piezoelectric device configured to change a liquid pressure in the pressure chamber, a drive waveform generator configured to generate a common drive waveform including, in one cycle, a first period having a discharge waveform to be supplied to the piezoelectric device to force the liquid out of the nozzle, the discharge waveform including a first element for changing a potential from a first potential to a second potential and a second element for changing a potential from the second potential to a third potential, and a second period having a first potential change waveform for decreasing deformation of the piezoelectric device as compared to deformation of the piezoelectric device when the first potential is supplied, the first potential change waveform including a first potential change element for changing a potential from the first potential to a fourth potential that is a potential between the first potential and the second potential, and a waveform selector configured to select the first period from the common drive waveform and supply the discharge waveform to the piezoelectric device in the first discharge section that discharges the liquid, and select the second period from the common drive waveform and supply the first potential change waveform to the piezoelectric device in the second discharge section that does not discharge the liquid.

DESCRIPTION OF EXEMPLARY EMBODIMENTS

A. First Embodiment

Figure 1:
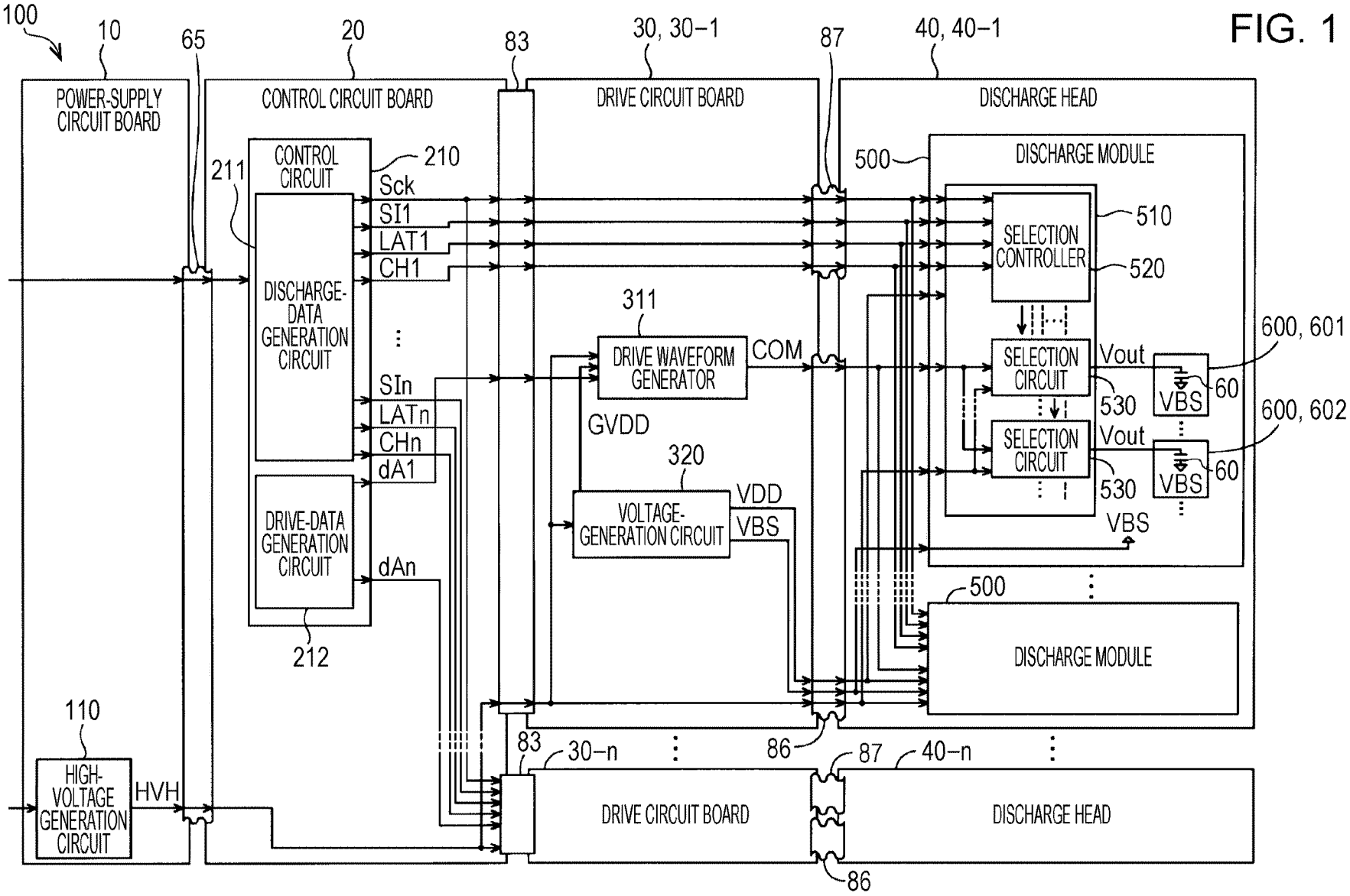
FIG. 1 is a block diagram illustrating an electrical configuration of a liquid discharge apparatus according to a first embodiment.

FIG. 1 is a block diagram illustrating an electrical configuration of a liquid discharge apparatus 100 according to the first embodiment. The liquid discharge apparatus 100 is, for example, an ink jet printer. The liquid discharge apparatus 100 includes a power-supply circuit board 10, a control circuit board 20, a plurality of drive circuit boards 30-1 to **30-*n*, and a plurality of discharge heads 40-1 to 40-*n***, where n is an integer greater than or equal to two, and means plurality.

The drive circuit boards 30-1 to **30-*n* are referred to as a drive circuit board 30 when all of the drive circuit boards 30-1 to 30-*n* have the same configuration and it is not necessary to distinguish individual drive circuit boards. The discharge heads 40-1 to 40-*n* are referred to as a discharge head 40 when all of the discharge heads have the same structure and it is not necessary to distinguish individual discharge heads. In this embodiment, a drive circuit board 30-*i*, where i=1 to n, and a discharge head 40-*i*** are disposed to correspond to each other.

On the power-supply circuit board 10, a high-voltage generation circuit 110 is provided. The power-supply circuit board 10 is electrically coupled to the control circuit board 20 via a first cable 65.

Based on a power source voltage that is input from the outside of the liquid discharge apparatus 100, the high-voltage generation circuit 110 generates a voltage HVH to be used in the liquid discharge apparatus 100, for example, a 42-VDC voltage signal, and outputs the signal to the control circuit board 20.

The power-supply circuit board 10 transmits a signal that is input from an external host computer of the liquid discharge apparatus 100 to the control circuit board 20.

The control circuit board 20 includes a control circuit 210, and is electrically coupled to the drive circuit board 30 via a board-to-board (BtoB) connector 83.

The control circuit 210 includes a discharge-data generation circuit 211 and a drive-data generation circuit 212. Based on various signals such as image data supplied from a host computer via the power-supply circuit board 10, the control circuit 210 generates various control signals for controlling the drive circuit board 30 and the discharge head 40 and outputs the signals.

Part of the signals input to the control circuit 210 are input to the discharge data generation circuit 211. Based on the input signal, the discharge data generation circuit 211 generates a plurality of types of control signals for controlling discharging of an ink from a discharge section 600.

More specifically, the discharge data generation circuit 211 generates n print data signals SI1 to SIn and n latch signals LAT1 to LATn for controlling times for discharging the ink from the discharge section 600, and outputs the signals to respective n drive circuit boards 30-1 to **30-*n*. The discharge data generation circuit 211 also generates n selection control signals CH1 to CHn, and outputs the signals to the respective n drive circuit boards 30-1 to 30-*n*. The selection control signal CH is also referred to as a change signal. In addition, the discharge data generation circuit 211 commonly outputs a clock signal Sck to the n drive circuit boards 30-1 to 30-*n*. To the drive circuit board 30-*i*, the clock signal Sck, the print data signal SIi, the latch signal LATi, and the selection control signal CHi are input. In the following description, the print data signals SI1 to SIn are collectively referred to as a print data signal SI, the latch signals LAT1 to LATn are collectively referred to as a latch signal LAT, and the selection control signals CH1** to CHn are collectively referred to as a selection control signal CH.

Part of the signals input to the control circuit 210 are input to the drive data generation circuit 212. Based on the input signals, the drive data generation circuit 212 generates n drive data dA1 to dAn that are original digital data for a common drive waveform COM for driving the discharge section 600, and outputs the drive data dA1 to dAn to n drive circuit boards 30-1 to **30-*n* respectively. To the drive circuit board 30-*i*, drive data dAi is input. In the following description, the drive data dA1 to dAn are collectively referred to as drive data dA. The drive data dA1 to dAn may be digital data that are analog-to-digital converted data of waveforms of drive voltages, or digital data that indicate differences from last drive data. The drive data dA1** to dAn may be digital data that define correspondence relationships between lengths of sections that have constant slopes and respective slopes in a drive waveform.

The control circuit board 20 has a wiring pattern that divides the voltage HVH that is generated in the high-voltage generation circuit 110, and outputs the voltage HVH to each of n drive circuit boards 30-1 to **30-*n*. The control circuit board 20** functions as a relay substrate that divides and transfers the voltage HVH.

The control circuit 210 on the control circuit board 20 may be provided on the power-supply circuit board 10. More specifically, print data signals SI1 to SIn, latch signals LAT1 to LATn, selection control signals CH1 to CHn, drive data dA1 to dAn that are generated in the control circuit 210 may be generated in the power-supply circuit board 10 and input to the control circuit board 20 via the first cable 65.

Various signals that are transferred from the power-supply circuit board 10 to the control circuit board 20 via the first cable 65 may be differential signals that are used in a low voltage differential signaling (LVDS) transmission mode, a low voltage positive emitter coupled logic (LVPECL) transmission mode, a current mode logic (CML) transmission mode, or the like that uses serial control signals. In such a case, the power-supply circuit board 10 is provided with a conversion circuit for converting various signals that are to be transferred to the control circuit board 20 into the differential signals, and the control circuit board 20 is provided with a restoration circuit for restoring the input differential signals.

The drive circuit board 30 is provided with a drive waveform generator 311 and a voltage generation circuit 320. The drive circuit board 30 is electrically coupled to the discharge head 40 via a second cable 86 and a third cable 87.

To the drive waveform generator 311, the drive data dA and the voltage HVH are input. The drive waveform generator 311 includes a circuit that generates a common drive waveform COM for driving respective piezoelectric devices 60 in the discharge head 40 based on the input drive data dA and voltage HVH, and outputs the common drive waveform COM to the discharge head 40.

For example, when drive data dA are digital data that are generated by performing analog-to-digital conversion to a common drive waveform COM, the drive waveform generator 311 performs digital-to-analog conversion to the drive data dA, and amplifies the converted data based on the voltage HVH to generate a common drive waveform COM.

Alternatively, for example, when drive data dA are digital data that define correspondence relationships between lengths of sections that have constant slopes and respective slopes in a waveform of a common drive waveform COM, the drive waveform generator 311 generates analog signals that satisfy the correspondence relationships between the lengths of the sections and the respective slopes that are defined by the drive data dA, and amplifies the generated signals based on the voltage HVH to generate a common drive waveform COM.

The voltage generation circuits 320 generate a plurality of voltage signals of a plurality of voltages based on the voltage HVH. More specifically, as a voltage signal, the voltage generation circuits 320 generate a voltage VBS that is supplied to the piezoelectric devices 60 in the discharge head 40, and output the voltage VBS to the discharge head 40. The voltage VBS is, for example, a voltage of 6 VDC. The voltage generation circuits 320 generate, as a voltage signal, a voltage VDD that is a power source voltage supplied to components in the discharge head 40, and output the voltage VDD to the discharge head 40. The voltage VDD is, for example, a voltage of 3.3 VDC. The voltage generation circuits 320 generate, as a voltage signal, a voltage GVDD for driving individual amplifiers in amplifier circuits in the drive waveform generators 311, and output the voltage GVDD to the drive waveform generators 311. The voltage GVDD is, for example, a voltage of 7.5 VDC. The voltage generation circuits 320 may generate voltage signals other than the above-described voltage signals.

The drive circuit board 30 transfers a print data signal SI, a latch signal LAT, a selection control signal CH, and a clock signal Sck that are input from the discharge data generation circuit 211 to the discharge head 40.

The drive circuit board 30 and the discharge head 40 are electrically coupled to each other with the second cable 86 and the third cable 87. The second cable 86 transfers the common drive waveform COM, the voltage VDD, and the voltage VBS from the drive circuit board 30 to the discharge head 40, and the third cable 87 transfers the print data signal SI, the latch signal LAT, the selection control signal CH, and the clock signal Sck. The second cable 86 and the third cable 87 may be integrated into one cable.

The discharge head 40 includes a plurality of discharge modules 500. Each discharge module 500 includes a waveform selector 510 and a plurality of discharge sections 600.

The waveform selector 510 includes a selection controller 520 and a plurality of selection circuits 530. The waveform selector 510 is, for example, an integrated circuit (IC) and operates on the voltage VDD.

To the selection controller 520, the print data signal SI, the latch signal LAT, the selection control signal CH, and the clock signal Sck that are input.

The selection controller 520 generates, to each of the selection circuits 530, a selection signal for controlling an output of a waveform in the common drive waveform COM based on the print data signal SI, and outputs the selection signal at a time determined by the latch signal LAT and the selection control signal CH.

To each selection circuit 530, the common drive waveform COM that is generated in the drive waveform generator 311 is input. The selection circuit 530 generates, based on the selection signal that is output from the selection controller 520, a drive voltage Vout from the common drive waveform COM and outputs the drive voltage Vout to the corresponding discharge section 600.

The discharge sections 600 includes a first discharge section 601 and a second discharge section 602. Each of the discharge sections 600 includes the piezoelectric device 60, and the discharge sections 600 correspond to the respective selection circuits 530. To one end of the piezoelectric device 60, the drive voltage Vout that is output from the selection circuit 530 is applied, and to the other end, the voltage VBS is applied. The piezoelectric device 60 deforms due to a potential difference between the drive voltage Vout and the voltage VBS, and the deformation forces an ink out of a nozzle 651 in the discharge section 600.

Figure 2:
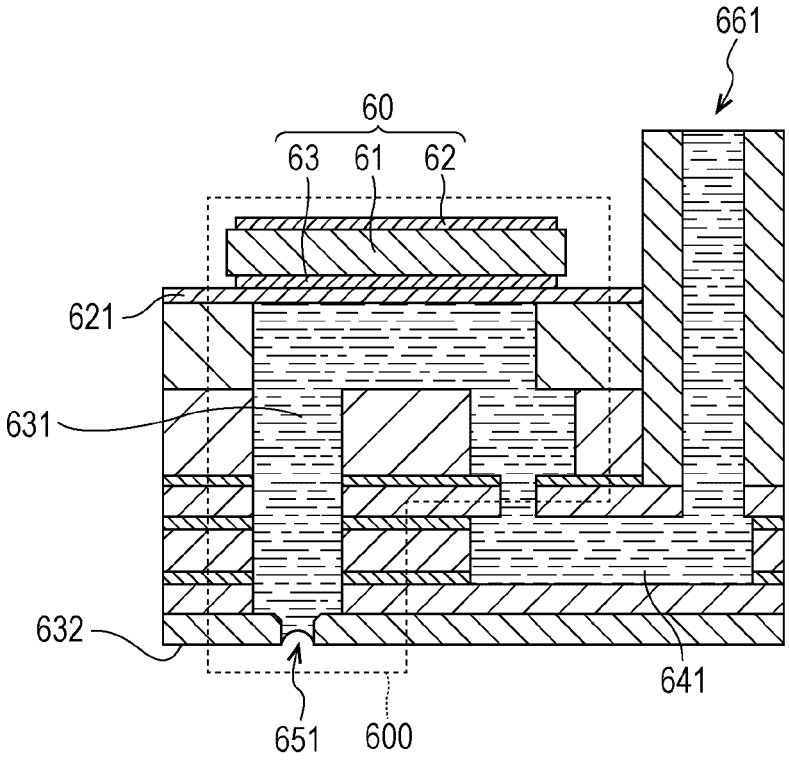
FIG. 2 illustrates a schematic structure of a discharge section.

FIG. 2 illustrates a schematic structure of a discharge section 600 in the discharge module 500. The discharge module 500 includes the discharge section 600 and a reservoir 641.

The reservoir 641 is provided for each color of ink, and the ink is supplied from a supply port 661 into the reservoir 641. The supply port 661 is coupled to an ink cartridge or an ink tank.

The discharge section 600 includes the nozzle 651 that discharges an ink as a liquid, a cavity 631 that functions as a pressure chamber and is in communication with the nozzle 651, the piezoelectric device 60 that functions as a pressure generating element that changes the ink pressure in the cavity 631, and a vibration plate 621. The piezoelectric device 60 that is disposed on an upper surface of the vibration plate 621 makes the vibration plate 621 bend and vibrate, and thereby the vibration plate 621 functions as a diaphragm that increases or decreases the internal volume of the cavity 631 that is filled with the ink. The nozzle 651 is an opening that is provided in a nozzle plate 632 and in communication with the cavity 631. The cavity 631 is filled with an ink and its internal volume changes as the piezoelectric device 60 deforms. The nozzle 651 is in communication with the cavity 631 and discharges the ink in the cavity 631 as an ink droplet as the internal volume of the cavity 631 changes.

The piezoelectric device 60 according to the embodiment includes a piezoelectric element 61, a first electrode 62 that is disposed on one side of the piezoelectric element 61, and a second electrode 63 that is disposed on the other side of the piezoelectric element 61. In other words, the piezoelectric device 60 includes the piezoelectric element 61 that is disposed between a pair of electrodes. To the first electrode 62, a drive voltage Vout is applied, and to the second electrode 63, a fifth potential that is higher than a second potential and lower than or equal to the voltage VBS is applied. In this embodiment, the fifth potential is the voltage VBS. A first potential to a fourth potential will be described below. In the description below, as long as not specifically mentioned, applying a voltage, potential, or waveform to the piezoelectric device 60 means applying a voltage, potential, or waveform to the first electrode 62 of the discharge section 600.

A potential difference between a voltage applied by the first electrode 62 and a voltage applied by the second electrode 63 makes the piezoelectric element 61 deform in the vertical direction in a central portion with respect to both end portions in FIG. 2 together with the first electrode 62, the second electrode 63, and the vibration plate 621. More specifically, the piezoelectric device 60 according to the embodiment deforms upward when the voltage of the drive voltage Vout becomes low and deforms downward when the voltage of the drive voltage Vout becomes high. In this structure, the piezoelectric device 60 that deforms upward increases the internal volume of the cavity 631, and thus the ink is drawn from the reservoir 641. On the other hand, the piezoelectric device 60 that deforms downward decreases the internal volume of the cavity 631, and depending on the extent of the contraction, the ink is discharged from the nozzle 651.

Figure 3:
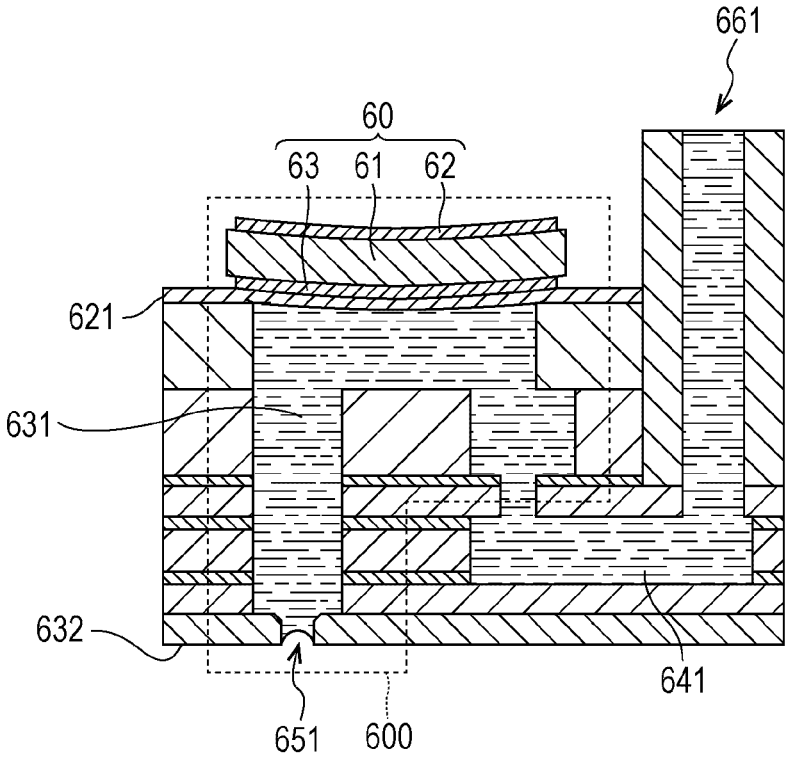
FIG. 3 illustrates a piezoelectric device that is in a bent state.

FIG. 3 illustrates the piezoelectric device 60 that is in a bent state. In this embodiment, in a state in which discharging of an ink is not performed during a print period, to the first electrode 62 of the piezoelectric device 60, an intermediate potential Vm that is higher than the voltage VBS is applied. The application produces a potential difference between the first electrode 62 and the second electrode 63, and thus the discharge section 600 slightly bends toward the nozzle 651 side as illustrated in FIG. 3. This application is performed prior to the ink discharge to increase the volume of the cavity 631 to sufficiently supply the ink from the reservoir 641 to the cavity 631. The intermediate potential Vm can be determined by experiments, simulations, or the like depending on the structure of the discharge section 600 and an amount of ink to be discharged.

The structure of the piezoelectric device 60 is not limited to the structure illustrated in FIG. 2 and FIG. 3, and may be any structure that deforms the piezoelectric device 60 to discharge an ink. The piezoelectric device 60 is not limited to the device that bends and vibrates, and may be a device that longitudinally vibrates.

In the discharge module 500, the piezoelectric devices 60 correspond to the respective cavities 631 and nozzles 651, and also correspond to the respective selection circuits 530. In the discharge module 500, accordingly, a set of the piezoelectric device 60, the cavity 631, the nozzle 651, and the selection circuit 530 is provided for each nozzle 651.

Figure 4:
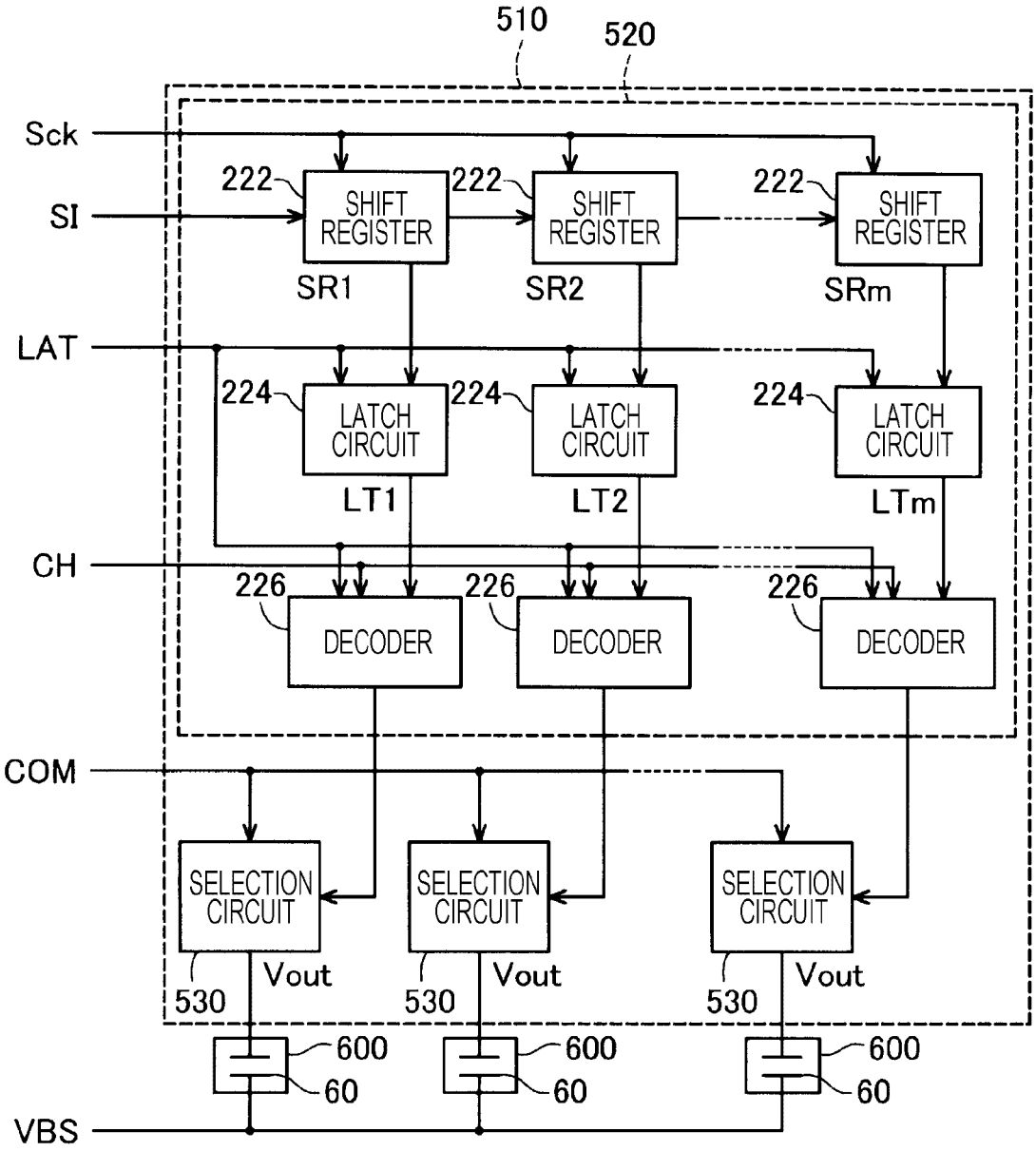
FIG. 4 illustrates a waveform selector.

FIG. 4 illustrates a structure of the waveform selector 510. The waveform selector 510 includes the selection controller 520 and the plurality of selection circuits 530.

To the selection controller 520, the clock signal Sck, the print data signal SI, the latch signal LAT, and the selection control signal CH are supplied. In the selection controller 520, a set of a shift register 222, a latch circuit 224, and a decoder 226 is provided for each piezoelectric device 60. In one waveform selector 510, accordingly, the number of sets of the shift registers 222, the latch circuits 224, and the decoders 226 is the same as the total number m of the nozzles 651.

The print data signal SI is in synchronization with the clock signal Sck, and contains data that causes respective m discharge sections 600 to discharge or not to discharge an ink.

The shift register 222 temporarily holds the print data signal SI. More specifically, the shift registers 222 of the same number of the stages of the piezoelectric devices 60 are cascaded and the serially supplied print data signal SI is sequentially transferred in accordance with the clock signal Sck to the latter stage. In FIG. 3, in order to distinguish the shift registers 222, the shift registers 222 are expressed as SR1, SR2, . . . SRm from the upstream side from which the print data signal SI is supplied.

The respective m latch circuits 224 latch the print data signal SI that is stored in the respective m shift registers 222 on the rising edge of the latch signal LAT.

In accordance with the print data signal SI that is latched in the individual m latch circuits 224, the m decoders 226 switch outputs of the selection signals to the selection circuits 530 to a H level or a L level for each period that is defined by the latch signal LAT and the selection control signal CH.

The discharge sections 530 are provided for the respective piezoelectric devices 60. In one waveform selector 510, accordingly, the number the selection circuits 530 is the same as the total number m of the nozzles 651. The selection circuit 530 selects, based on a selection signal, whether to output the common drive waveform COM as the drive voltage Vout. More specifically, when a selection signal is at the H level, the selection circuit 530 brings the drive waveform generator 311 and the piezoelectric device 60 into conduction to output a corresponding part of the common drive waveform COM as the drive voltage Vout. On the other hand, when the selection signal is at the L level, the selection circuit 530 brings the drive waveform generator 311 and the piezoelectric device 60 out of conduction. When the drive waveform generator 311 and the discharge section 600 are disconnected, the last voltage is maintained by the capacitiveness of the piezoelectric device 60, and the last voltage is the drive voltage Vout.

Figure 5:
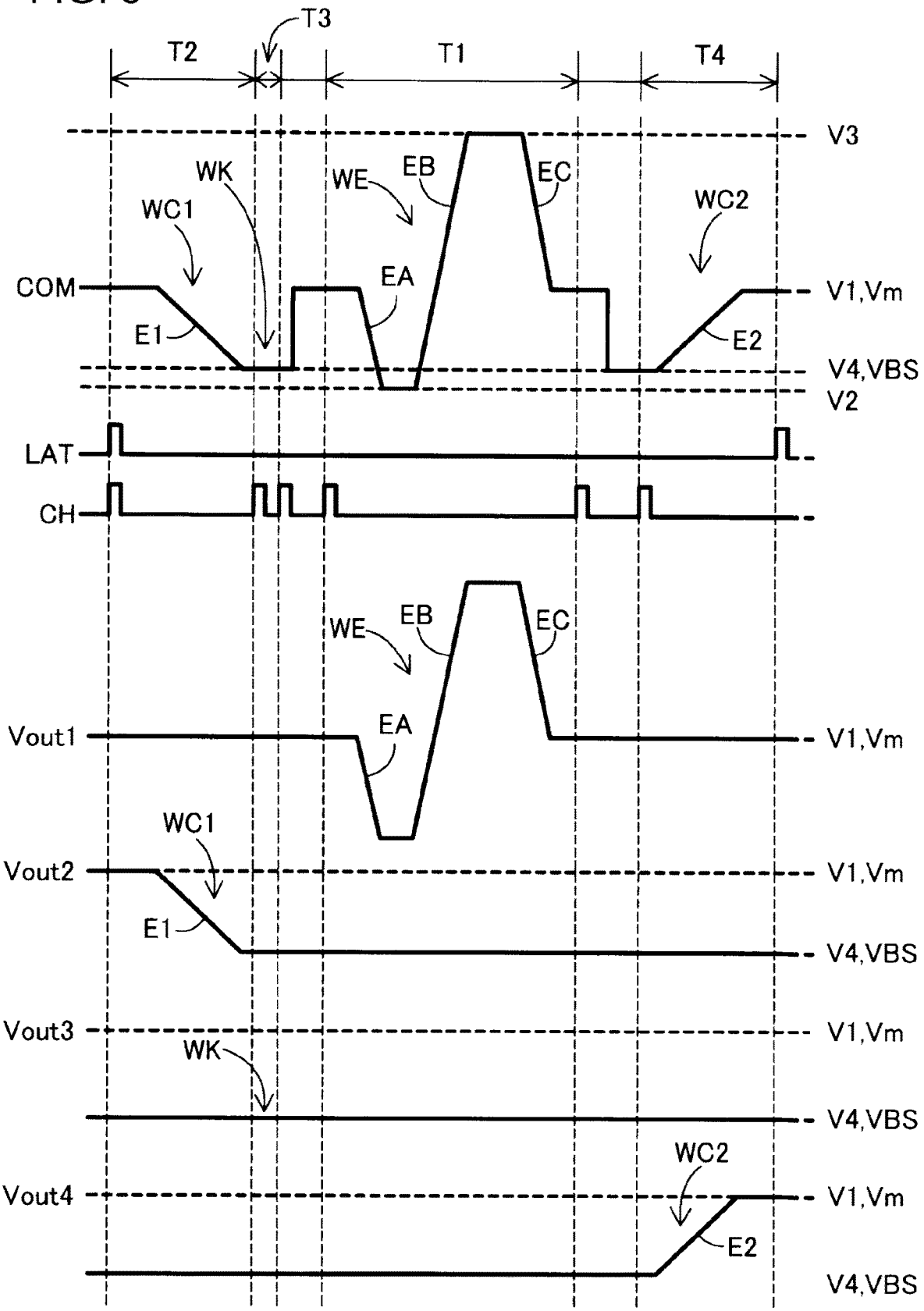
FIG. 5 illustrates a common drive waveform and waveforms of drive voltages.

FIG. 5 illustrates the common drive waveform COM and waveforms of drive voltages Vout. The common drive waveform COM according to the embodiment includes, in one cycle, a plurality of periods that are divided by the latch signal LAT and the selection control signal CH. The periods include a first period T1, a second period T2, a third period T3, and a fourth period T4. These periods are included in the cycle of the common drive waveform COM, and their time-based relationship is not particularly limited.

The first period T1 includes a discharge waveform WE that is supplied to the piezoelectric device 60 to force the ink out of the nozzle 651. The discharge waveform WE includes a first element EA for changing a potential from a first potential V1 to a second potential V2, and a second element EB for changing a potential from the second potential V2 to a third potential V3. The discharge waveform WE according to the embodiment includes a third element EC for changing a potential from the third potential V3 to the first potential. The first potential V1 according to the embodiment is the intermediate potential Vm. The second potential V2 according to the embodiment is lower than the first potential V1 and lower than the voltage VBS. The third potential V3 is higher than the first potential V1 and the second potential V2.

FIG. 5 illustrates a drive voltage Vout1 that is a drive voltage Vout selected from the common drive waveform COM in the first period T1 and output. When the discharge waveform WE is supplied in accordance with the drive voltage Vout1 to the piezoelectric device 60, in accordance with the first element EA, the piezoelectric device 60 deforms such that the volume in the cavity 631 increases from a normal volume that corresponds to the intermediate potential Vm to an expansion volume that corresponds to the second potential V2 and thereby the pressure of the ink in the cavity 631 fluctuates at a natural frequency. Then, in accordance with the second element EB, the piezoelectric device 60 deforms such that the volume in the cavity 631 rapidly decreases to a contraction volume that corresponds to the third potential V3. The amount of an ink droplet and the flying speed of the ink droplet discharged from the nozzle 651 depend on the contraction timing with respect to the fluctuation occurring in the ink pressure in the cavity 631. The pressure of the ink in the cavity 631 that decreases due to the ink droplet discharge fluctuates at a natural frequency. Then, in accordance with the third element EC, the piezoelectric device 60 deforms such that the volume in the cavity 631 expands to the volume that corresponds to the intermediate potential Vm.

The second period T2 includes a first potential change waveform WC1. The first potential change waveform WC1 includes a first potential change element E1 for changing a potential from the first potential V1 to the fourth potential V4. The fourth potential V4 according to the embodiment is lower than the first potential V1 and corresponds to the voltage VBS. FIG. 5 illustrates a drive voltage Vout2 that is a drive voltage Vout selected from the common drive waveform COM in the second period T2 and output. When the first potential change waveform WC1 is applied in accordance with the drive voltage Vout2 to the piezoelectric device 60, the potential that is applied to the piezoelectric device 60 changes from the intermediate potential Vm to the voltage VBS. As a result, the potential difference between the first electrode 62 and the second electrode 63 becomes zero, and the shape of the piezoelectric device 60 is changed from the bent state illustrated in FIG. 3 into a flat state illustrated in FIG. 2. In this specification, "flat" is not limited to a completely horizontal state, and may be a state flatter than a state in which the intermediate potential Vm is applied to the first electrode 62.

In this embodiment, an amount of change in potential per unit time of the first potential change element E1 in the first potential change waveform WC1 is smaller than an amount of change in potential per unit time of the first element EA for changing a potential from the first potential V1 to the second potential V2 in the discharge waveform WE. Accordingly, when the first potential change waveform WC1 is applied to the piezoelectric device 60, the piezoelectric device 60 relatively gently changes its shape from the bent state to the flat state.

The third period T3 includes a potential maintaining waveform WK for maintaining the voltage VBS. FIG. 5 illustrates a drive voltage Vout3 that is a drive voltage Vout selected from the common drive waveform COM in the third period T3 and output. When the drive voltage Vout3 is applied to the piezoelectric device 60, the piezoelectric device 60 maintains a flat state as illustrated in FIG. 2.

The fourth period T4 includes a second potential change waveform WC2. The second potential change waveform WC2 includes a second potential change element E2 for changing a potential from the fourth potential V4 to the first potential V1. FIG. 5 illustrates a drive voltage Vout4 that is a drive voltage Vout selected from the common drive waveform COM in the fourth period T4 and output. When the second potential change waveform WC2 is applied to the piezoelectric device 60 in accordance with the drive voltage Vout4, the potential that is applied to the piezoelectric device 60 changes from the voltage VBS to the intermediate potential Vm. As a result, the shape of the piezoelectric device 60 is changed from the flat state illustrated in FIG. 2 into a bent state illustrated in FIG. 3.

In this embodiment, an amount of change in potential per unit time of the second potential change element E2 in the second potential change waveform WC2 is smaller than an amount of change in potential per unit time of the first element EA for changing a potential from the first potential V1 to the second potential V2 in the discharge waveform WE. Accordingly, when the second potential change waveform WC2 is applied to the piezoelectric device 60, the piezoelectric device 60 relatively gently changes its shape from the flat state to the bent state.

The selection circuits 530 illustrated in FIG. 4 supply a waveform in a period that is selected from the first period T1 to the fourth period T4 in the common drive waveform COM to the piezoelectric devices 60 in a corresponding discharge section 600 among the discharge sections 600 that include the first discharge section 601 and the second discharge section 602.

In the description below, the first discharge section 601 is a discharge section 600 that discharges an ink, and the second discharge section 602 is a discharge section 600 that does not discharge an ink. In this specification, "discharge section 600 that discharges an ink" means a discharge section 600 that is used during a print period among the discharge sections 600 in the discharge head 40. On the other hand, "discharge section 600 that does not discharge an ink" means a discharge section 600 that is not used during a print period among the discharge sections 600 in the discharge head 40. In addition, the discharge sections 600 that do not discharge an ink may include discharge sections 600 that are determined to be faulty in a discharge failure inspection performed with the piezoelectric devices 60, or discharge sections 600 that are located outside a recording medium.

When a printing process is started in the liquid discharge apparatus 100, to the piezoelectric device 60 in the first discharge section 601 that discharges an ink, the waveform selector 510 selects the first period T1 from the common drive waveform COM and supplies the discharge waveform WE. By the processing, to the first discharge section 601, the drive voltage Vout1 illustrated in FIG. 5 is supplied, the ink is discharged from the nozzle 651, and a dot is formed on the recording medium.

Immediately after the printing process is started in the liquid discharge apparatus 100, to the piezoelectric device 60 in the second discharge section 602 that does not discharge an ink, the waveform selector 510 selects the second period T2 from the common drive waveform COM and supplies the first potential change waveform WC1. By the processing, to the second discharge section 602, the drive voltage Vout2 illustrated in FIG. 5 is supplied. When the drive voltage Vout2 is supplied to the second discharge section 602, the voltage applied to the piezoelectric device 60 is changed from the intermediate potential Vm to the voltage VBS, and the piezoelectric device 60 becomes a flat state as illustrated in FIG. 2.

Furthermore, in this embodiment, in a period after the first potential change waveform WC1 is supplied to the piezoelectric device 60 of the second discharge section 602 that does not discharge the ink, the waveform selector 510 controls the selection circuit 530 such that the potential maintaining waveform WK in the third period T3 in the common drive waveform COM is supplied to the piezoelectric device 60 of the second discharge section 602. By the processing, to the second discharge section 602, the drive voltage Vout3 illustrated in FIG. 5 is supplied, and thus the voltage VBS is applied to the piezoelectric device 60 of the second discharge section 602, and the piezoelectric device 60 is maintained in a flat state.

In this embodiment, in completing the printing, in a period after the potential maintaining waveform WK is supplied to the piezoelectric device 60 of the second discharge section 602 that does not discharge the ink, the waveform selector 510 supplies the second potential change waveform WC2 in the fourth period T4 in the common drive waveform COM to the piezoelectric device 60 of the second discharge section 602. By the processing, to the second discharge section 602, the drive voltage Vout4 illustrated in FIG. 5 is supplied, and thus the intermediate potential Vm is applied to the piezoelectric device 60 of the second discharge section 602. As a result, when the printing is completed, the piezoelectric device 60 returns from the flat state to the bent state illustrated in FIG. 3.

The print data signal SI that is sent from the control circuit 210 specifies a period in the common drive waveform COM to be selected by the waveform selector 510. More specifically, the print data signal SI includes data that causes, in synchronization with the clock signal Sck, to perform at least one of the following processes: 1. forming a dot; 2. outputting the first potential change waveform WC1; 3. outputting the second potential change waveform WC2; 4. outputting the potential maintaining waveform WK; and 5. not selecting any of the first to fourth periods. The decoder 226 selects a period that corresponds to the data from the common drive waveform COM, and outputs a selection signal for selecting the period to the selection circuit 530. The waveform selector 510 thus controls the selection circuits 530 to output desired waveforms to the first discharge section 601 and the second discharge section 602 respectively.

The liquid discharge apparatus 100 according to the embodiment supplies, to the piezoelectric device 60 of the second discharge section 602 that does not discharge the ink, the first potential change waveform WC1 for decreasing the deformation of the piezoelectric device 60 as compared to that when the intermediate potential Vm is applied. Consequently, the piezoelectric device 60 is not always subject to stress, and deterioration of the piezoelectric device 60 can be suppressed. In particular, in this embodiment, the fifth potential that is applied to the second electrode 63 of the piezoelectric device 60 is the voltage VBS, and the fourth potential that is applied to the first electrode 62 after the supply of the first potential change waveform WC1 is also the voltage VBS. Accordingly, the deformation of the piezoelectric element 61 in the second discharge section 602 can be minimized, and possible deterioration in the piezoelectric device 60 can be largely reduced. Such an effect is significant when the nozzles 651 are arranged in the nozzle plate 632 at a high density, and a thin piezoelectric device 60 that has a thickness of 10 μm or less that tends to crack is employed.

Furthermore, in this embodiment, after the first potential change waveform WC1 is supplied to the piezoelectric device 60 of the second discharge section 602 that does not discharge the ink, the potential maintaining waveform WK in the third period T3 in the common drive waveform COM is supplied. Accordingly, during the print period, the piezoelectric device 60 of the second discharge section 602 that does not discharge the ink is less subject to deformation.

Furthermore, in this embodiment, after the potential maintaining waveform WK is supplied to the piezoelectric device 60 of the second discharge section 602 that does not discharge the ink, the second potential change waveform WC2 in the fourth period T4 in the common drive waveform COM is supplied. Accordingly, after the printing is completed, the deformation of the piezoelectric device 60 of the second discharge section 602 that does not discharge the ink can be returned to the original state. Consequently, for example, maintenance processing such as flushing processing or cleaning processing that is performed after completion of printing can be started in a state in which the piezoelectric devices 60 in the first discharge section 601 and the second discharge section 602 are in the same deformation state.

In this embodiment, an amount of change in potential per unit time of the first potential change element E1 in the first potential change waveform WC1 is smaller than an amount of change in potential per unit time of the first element EA in the discharge waveform WE. Accordingly, when the first potential change waveform WC1 is applied, the pressure fluctuation in the nozzle 651 and the cavity 631 due to the deformation of the piezoelectric device 60 can be suppressed as compared to the pressure fluctuation during the discharging. As a result, spreading of thickened ink into the cavity 631 can be reduced and the discharging of the thickened ink by flushing processing or cleaning processing after the completion of the printing can be readily performed.

B. Second Embodiment

Figure 6:
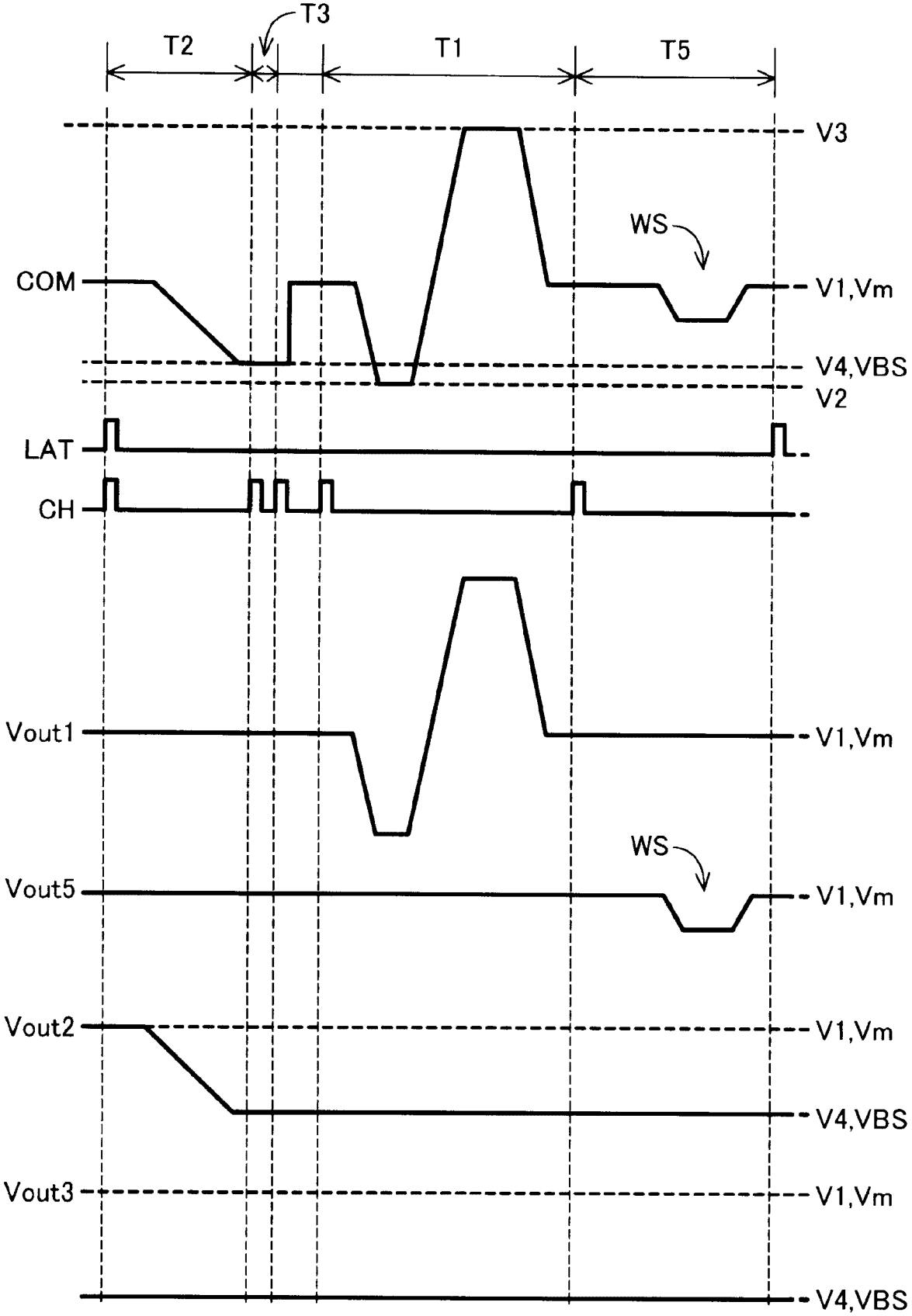
FIG. 6 illustrates a common drive waveform and waveforms of drive voltages according to a second embodiment.

FIG. 6 illustrates a common drive waveform COM and waveforms of drive voltages Vout according to the second embodiment. A structure of the liquid discharge apparatus 100 according to the second embodiment is similar to that in the first embodiment. The common drive waveform COM according to the embodiment includes a fifth period T5 instead of the fourth period T4 in the first embodiment. The fifth period T5 includes an inverted trapezoidal mocrovibration waveform WS that falls from the intermediate potential Vm and after a short time, rises to the intermediate potential Vm. The potential after the fall of the mocrovibration waveform WS is lower than the intermediate potential Vm and higher than the voltage VBS.

When the waveform selector 510 receives data according to the print data signal SI that causes the first discharge section 601 that discharges an ink not to form a dot, the waveform selector 510 selects the fifth period T5 from the common drive waveform COM with the decoder 226 and outputs a selection signal for selecting the fifth period T5 to the selection circuit 530. By the processing, to the first discharge section 601 that discharges the ink, the drive voltage Vout5 illustrated in FIG. 6 is supplied, and thus the mocrovibration waveform WS is applied to the piezoelectric device 60. Accordingly, thickening of the ink around the nozzle 651 of the first discharge section 601 can be suppressed.

It should be noted that the common drive waveform COM according to the embodiment includes the fifth period T5 instead of the fourth period T4 in the first embodiment; however, the common drive waveform COM may be a waveform that includes both of the fourth period T4 and the fifth period T5.

C. Other Embodiments

Figure 7:
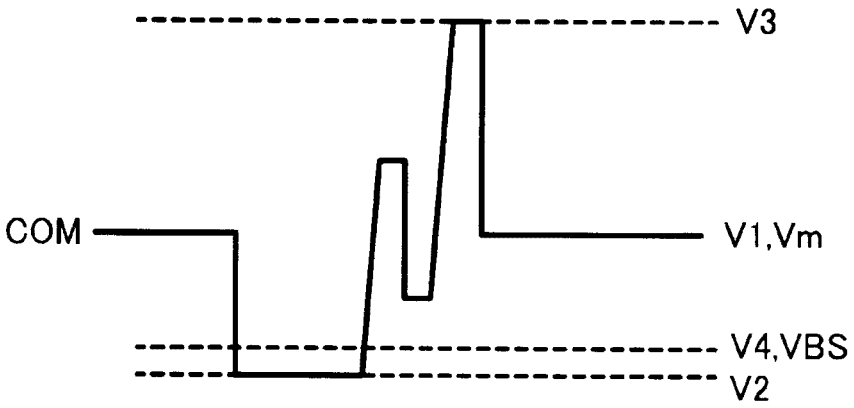
FIG. 7 illustrates another example waveform in a common drive waveform.

C-1. The common drive waveform COM according to the embodiments may include the discharge waveform WE illustrated in FIG. 5, the mocrovibration waveform WS illustrated in FIG. 6, or other waveforms. For example, as illustrated in FIG. 7, the common drive waveform COM may include a waveform that falls, rises once, falls again, and rises again. According to the waveform, an ink droplet smaller than that according to the discharge waveform WE illustrated in FIG. 5 can be discharged. Furthermore, the waveform of the discharge waveform WE may be any waveform that forces the ink out of the nozzle 651, and the waveform is not limited to the waveforms illustrated in FIG. 5 to FIG. 7. For example, a waveform that has a simple shape such as a trapezoid or a rectangle may be used. The magnitude relation in potential of the waveform elements in the respective waveforms may be reversed depending on the structure of the discharge section 600 or the structure of the piezoelectric device 60.

C-2. In the above-described embodiments, the common drive waveform COM includes the potential maintaining waveform WK. The common drive waveform COM, however, may not include the potential maintaining waveform WK. In such a case, after the first potential change waveform WC1 is supplied to the piezoelectric device 60, the waveform selector 510 may disconnect the discharge data generation circuit 211 and the discharge section 600 to substantially maintain a state in which the voltage VBS is applied to the first electrode 62.

C-3. In the above-described embodiments, the common drive waveform COM may not include the second potential change waveform WC2. In such a case, until the liquid discharge apparatus 100 is restarted, a state in which the voltage VBS is applied to the second discharge section 602 may be maintained.

C-4. In the above-described embodiments, the voltage that is applied to the second electrode 63 of the piezoelectric device 60 may be a voltage other than the voltage VBS. For example, a potential that is lower than the voltage VBS and higher than 0 V may be applied. That is, when the first potential change waveform WC1 is applied to the piezoelectric device 60 in the second discharge section 602, a potential difference between the first electrode 62 and the second electrode 63 may be any potential difference at which deterioration of the piezoelectric device 60 can be suppressed, and may be a potential difference other than zero.

C-5. In the above-described embodiments, an amount of change in potential per unit time of the first potential change element E1 in the first potential change waveform WC1 is smaller than an amount of change in potential per unit time of the first element EA in the discharge waveform WE. However, an amount of change in potential per unit time of the first potential change element E1 may be larger than an amount of change in potential per unit time of the first element EA. Alternatively, the amounts of change in potential per unit time may be the same amount.

C-6. In the above-described embodiments, an amount of change in potential per unit time of the second potential change element E2 in the second potential change waveform WC2 is smaller than an amount of change in potential per unit time of the first element EA in the discharge waveform WE. However, an amount of change in potential per unit time of the second potential change element E2 may be larger than an amount of change in potential per unit time of the first element EA. Alternatively, the amounts of change in potential per unit time may be the same amount.

C-7. The liquid discharge apparatus 100 according to the above-described embodiments is an apparatus that discharges an ink. The liquid discharge apparatus 100, however, may discharge not only ink but may discharge liquids other than ink.

D. Other Aspects

The present disclosure is not limited to the above-described embodiments, and various modifications may be made without departing from the scope of the present disclosure. For example, technical features in the embodiments corresponding to the technical features in aspects described below may be replaced or combined to solve some or all of the above-described problems or to achieve some or all of the above-described effects. Unless the technical features are described as essential in this specification, the technical features may be omitted as appropriate.

1. According to an aspect of the present disclosure, a liquid discharge apparatus is provided. The liquid discharge apparatus includes a first discharge section including a nozzle configured to discharge a liquid, a pressure chamber in communication with the nozzle, and a piezoelectric device configured to change a liquid pressure in the pressure chamber, a second discharge section including a nozzle configured to discharge the liquid, a pressure chamber in communication with the nozzle, and a piezoelectric device configured to change a liquid pressure in the pressure chamber, a drive waveform generator configured to generate a common drive waveform including, in one cycle, a first period having a discharge waveform to be supplied to the piezoelectric device to force the liquid out of the nozzle, the discharge waveform including a first element for changing a potential from a first potential to a second potential and a second element for changing a potential from the second potential to a third potential, and a second period having a first potential change waveform for decreasing deformation of the piezoelectric device as compared to deformation of the piezoelectric device when the first potential is supplied, the first potential change waveform including a first potential change element for changing a potential from the first potential to a fourth potential that is a potential between the first potential and the second potential, and a waveform selector configured to select the first period from the common drive waveform and supply the discharge waveform to the piezoelectric device in the first discharge section that discharges the liquid, and select the second period from the common drive waveform and supply the first potential change waveform to the piezoelectric device in the second discharge section that does not discharge the liquid. According to the aspect, to the piezoelectric device of the second discharge section that does not discharge the liquid, the first potential change waveform for decreasing the deformation of the piezoelectric device is supplied. As a result, the piezoelectric device is not always subject to stress, and deterioration of the piezoelectric device can be suppressed.

2. In this aspect, the common drive waveform may further include, in the cycle, a third period having a potential maintaining waveform for maintaining the fourth potential, and the waveform selector may be configured to supply, after the first potential change waveform is supplied to the piezoelectric device in the second discharge section that does not discharge the liquid, the potential maintaining waveform in the third period from the common drive waveform to the piezoelectric device in the second discharge section that does not discharge the liquid. According to the aspect, a state in which the piezoelectric device of the second discharge section that does not discharge the liquid is less deformed can be maintained.

3. In this aspect, the common drive waveform may further include, in the cycle, a fourth period having a second potential change waveform including a second potential change element for changing a potential from the fourth potential to the first potential, and the waveform selector may be configured to supply, after the potential maintaining waveform is supplied to the piezoelectric device in the second discharge section that does not discharge the liquid, the second potential change waveform in the fourth period from the common drive waveform to the piezoelectric device in the second discharge section that does not discharge the liquid. According to the aspect, the deformation of the piezoelectric device of the second discharge section that does not discharge the liquid can be returned to the original state.

4. In this aspect, the piezoelectric device may include a piezoelectric element, a first electrode that is disposed on one side of the piezoelectric element, and a second electrode that is disposed on the other side of the piezoelectric element. To the first electrode, the waveform in a period selected from the common drive waveform may be applied, and to the second electrode, a fifth potential that is lower than or equal to the fourth potential may be applied. According to the aspect, the piezoelectric element can be driven based on a differential pressure between the waveform that is applied to the first electrode and the fifth potential.

5. In this aspect, the fourth potential may be equal to the fifth potential. According to the aspect, the deformation of the piezoelectric element of the second discharge section that does not discharge the liquid is can be suppressed.

6. In this aspect, an amount of change in potential per unit time of the first potential change element in the first potential change waveform may be smaller than an amount of change in potential per unit time of the first element in the discharge waveform. According to the aspect, a rapid deformation of the piezoelectric device upon the application of the first potential change waveform can be suppressed.

The present disclosure is not limited to the above-described embodiments as the liquid discharge apparatus, and for example, may be various methods for controlling the liquid discharge apparatus, or methods for driving the piezoelectric device in the liquid discharge apparatus.

What is claimed is:

1. A liquid discharge apparatus comprising:

a first discharge section comprising a nozzle configured to discharge a liquid, a pressure chamber in communication with the nozzle, and a piezoelectric device configured to change a liquid pressure in the pressure chamber;

a second discharge section comprising a nozzle configured to discharge the liquid, a pressure chamber in communication with the nozzle, and a piezoelectric device configured to change a liquid pressure in the pressure chamber;

a drive waveform generator configured to generate a common drive waveform comprising, in one cycle, a first period having a discharge waveform to be supplied to the piezoelectric device to force the liquid out of the nozzle, the discharge waveform including a first element for changing a potential from a first potential to a second potential and a second element for changing a potential from the second potential to a third potential, a second period having a first potential change waveform for decreasing deformation of the piezoelectric device as compared to deformation of the piezoelectric device when the first potential is supplied, the first potential change waveform including a first potential change element for changing a potential from the first potential to a fourth potential that is a potential between the first potential and the second potential, a third period having a potential maintaining waveform for maintaining the fourth potential, and a fourth period having a second potential change waveform including a second potential change element for changing a potential from the fourth potential to the first potential, the first period and the third period being between the second period and the fourth period; and a waveform selector configured to select the first period from the common drive waveform and supply the discharge waveform to the piezoelectric device in the first discharge section that discharges the liquid, and select the second period from the common drive waveform and supply the first potential change waveform to the piezoelectric device in the second discharge section that does not discharge the liquid, in an one cycle period.

2. The liquid discharge apparatus according to claim 1, wherein the waveform selector is configured to supply the potential maintaining waveform in the third period from the common drive waveform to the piezoelectric device in the second discharge section that does not discharge the liquid in an one cycle period that is after the one cycle period where the first potential change waveform is supplied to the piezoelectric device in the second discharge section.

3. The liquid discharge apparatus according to claim 2, wherein the waveform selector is configured to supply the second potential change waveform in the fourth period from the common drive waveform to the piezoelectric device in the second discharge section that does not discharge the liquid in an one cycle period that is after the one cycle period where the potential maintaining waveform is supplied to the piezoelectric device in the second discharge.

4. The liquid discharge apparatus according to claim 1, wherein the piezoelectric device includes a piezoelectric element, a first electrode that is disposed on one side of the piezoelectric element, and a second electrode that is disposed on the other side of the piezoelectric element, to the first electrode, the waveform in a period selected from the common drive waveform is applied, and to the second electrode, a fifth potential that is lower than or equal to the fourth potential is applied.

5. The liquid discharge apparatus according to claim 4, wherein the fourth potential is equal to the fifth potential.

6. The liquid discharge apparatus according to claim 1, wherein an amount of change in potential per unit time of the first potential change element in the first potential change waveform is smaller than an amount of change in potential per unit time of the first element in the discharge waveform.

* * * * *